United States Patent [19]

Miller

[11] 4,169,781

[45] Oct. 2, 1979

[54] DENITRIFICATION BY FURFURAL-FERRIC CHLORIDE EXTRACTION OF COKER OIL

[75] Inventor: Stephen J. Miller, Emeryville, Calif.

[73] Assignee: Chevron Research Company, San Francisco, Calif.

[21] Appl. No.: 912,153

[22] Filed: Jun. 2, 1978

[51] Int. Cl.[2] ..... C10G 29/12; C10G 21/16

[52] U.S. Cl. ..... 208/97; 208/254 R

[58] Field of Search ..... 208/254 R, 97, 131

[56] References Cited

U.S. PATENT DOCUMENTS

| | | | |
|---|---|---|---|
| 2,796,387 | 6/1957 | Schmidt | 208/254 R |
| 2,800,427 | 7/1957 | Junk, Jr. et al. | 208/254 R |
| 2,883,336 | 4/1959 | Sweetser et al. | 208/97 |
| 3,193,496 | 7/1965 | Hartung | 208/254 R |

*Primary Examiner*—George Crasanakis

*Attorney, Agent, or Firm*—D. A. Newell; R. H. Davies; R. H. Evans

[57] ABSTRACT

A process is disclosed for denitrification of a hydrogenated oil, which is particularly applicable to coal-derived oils. The oil is first coked to yield a solid coke product and a coker oil having a reduced nitrogenous compound content. The coker oil nitrogen compounds are then selectively removed from the oil by liquid-liquid extraction using a solution of ferric chloride in furfural as the extracting medium. The extraction is carried out under moderate conditions of temperature and pressure.

7 Claims, 1 Drawing Figure

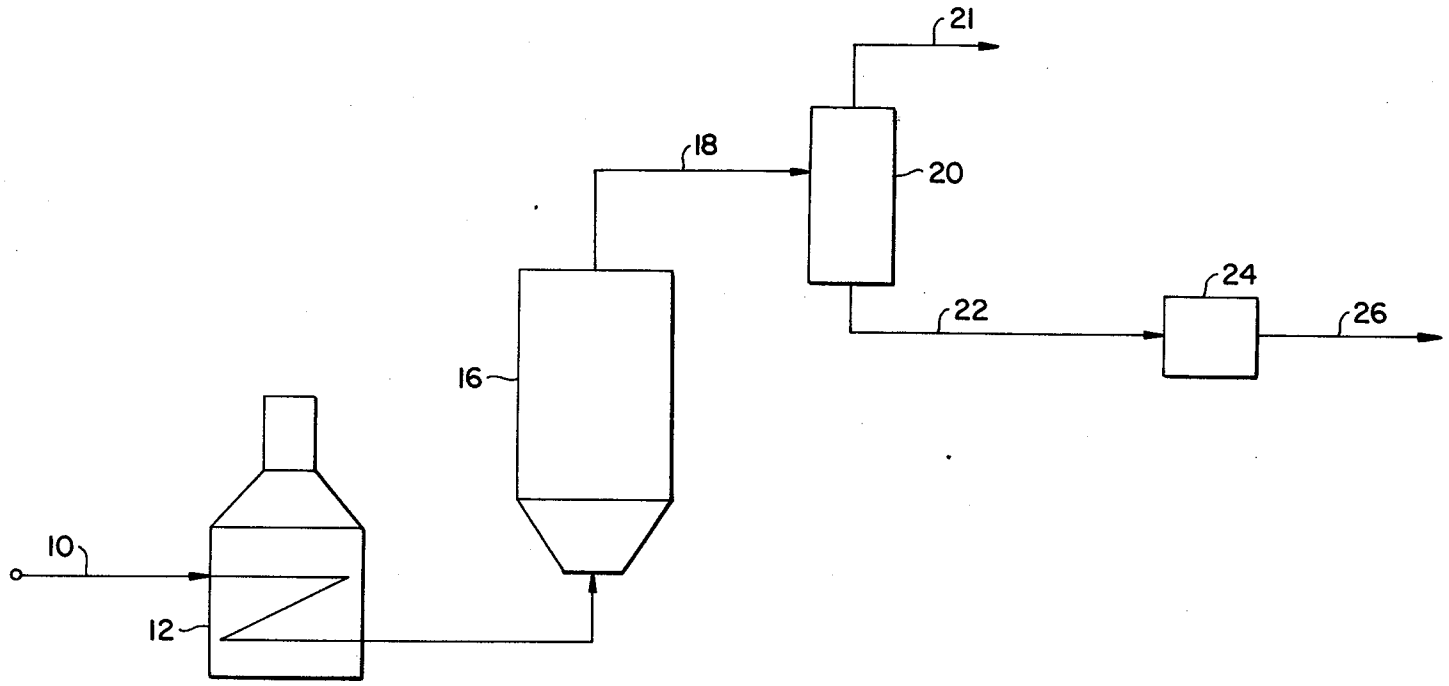
10
12
16
18
20
21
22
24
26

DENITRIFICATION BY FURFURAL-FERRIC CHLORIDE EXTRACTION OF COKER OIL

BACKGROUND OF THE INVENTION

1. Field of the Invention

This invention relates to upgrading a hydrogenated oil. More particularly, a combination process is provided wherein the nitrogen compounds of an oil, such as a coal oil, are substantially removed by a combination of coking and liquid-liquid selective extraction steps.

2. Prior Art

As a consequence of the diminishing supplies of petroleum and the corollary increase in cost thereof, extensive research efforts have been directed to develop feasible commercial processes for the production of liquid and gaseous fuels from coal resources. Of particular importance are those processes being developed for the direct conversion of coal to liquid hydrocarbon fuels or synthetic crudes. In this type of process, raw coal is typically dissolved in a hydrogen-donor solvent, or the equivalent, to produce a liquid hydrocarbon which may be further processed to produce gasoline, fuel oils, or petrochemicals. Unfortunately, the raw coal normally contains appreciable quantities of nitrogen-bearing compounds which remain in the synthetic crude. Typical levels of nitrogen compounds remaining in the coal-derived oil are usually in the range of 300 to 1000 ppmw, measured as nitrogen. It is well known in the art that nitrogen contaminants in these concentrations have a deleterious effect on most acidic catalysts used in conventional hydroprocessing steps. Under the process conditions such as those encountered in hydrotreating or hydrofining processes, the nitrogen is converted to ammonia, which acts to poison the catalyst, and causes costly shutdowns, catalyst loss, and/or expensive onstream regenerating equipment.

It is therefore an object of this invention to provide a noncatalytic process for upgrading hydrogenated oils, and particularly coal-derived oils, by substantially reducing the nitrogen contaminant content thereof.

SUMMARY OF THE INVENTION

In accordance with the present invention, a process is provided for upgrading a hydrogenated oil containing nitrogenous compounds above 300 parts per million by weight, which comprises: (1) coking said oil to produce coke and a coker oil, said coker oil having a disproportionately lower quantity of nitrogenous compounds by weight therein than said coke; (2) extracting a major portion of said remaining nitrogenous components from said coker oil with a solution of ferric chloride, said extracting being under conditions including (a) a temperature in the range of from about 0° C. to 50° C. and (b) a solution-to-oil volume ratio in the range of from about 0.1 to 5, said solution containing at least a major portion of furfural as a solvent thereof containing said ferric chloride therein in the range of from about 0.001 to 10 weight percent, thereby forming a raffinate oil phase containing a minor portion of said nitrogenous component and an extract phase containing a major portion of said nitrogenous component; and (3) separating said raffinate oil phase from said extract phase.

Further in accordance with one aspect of said invention, it is preferred that said coking step be accomplished by means of a delayed coking process, and still further in accordance with a preferred method of practicing said invention the extracting and separation steps are accomplished by the continuous countercurrent contacting of the solution and oil.

Said separation step may also advantageously be conducted at a temperature lower than the extraction step, if preferred.

It is preferred that said solvent consist essentially of furfural and that said ferric chloride be present in said furfural in the range of approximately 0.1 to 1.0 weight percent. A particularly preferred volume ratio of solvent to oil ranges from 0.5 to 1.5. A particularly preferred temperature range for conducting the extraction step is from approximately 10° C. to 30° C.

BRIEF DESCRIPTION OF THE DRAWING

The drawing illustrates a schematic flow diagram and apparatus suitable for practicing one embodiment of the invention.

DETAILED DESCRIPTION OF THE PREFERRED EMBODIMENT

Referring to the drawing, there is shown a schematic flow diagram and apparatus suitable for practicing one embodiment of the invention. A hydrogenated oil feedstock containing nitrogen contaminants is introduced to a fired heater 12 through line 10. The heated charge passes from fired heater 12 through line 14 to a coke drum 16. Gases and coker oils pass overhead from drum 16 through line 18 to a fractionator 20. In fractionator 20 the light gases are separated from the coker oils and pass overhead through line 21. For purposes of simplification and illustration, coker oil is shown as a bottoms product 22 from fractionator 20; however, said oil might typically be taken as a fractionator side cut and the fractionator bottoms recycled to the fired heater in an extinction cycle. From line 22 the coker oil passes to extraction unit 24. In unit 24, the nitrogen compounds remaining in the coker oil are extracted with a solution of ferric chloride and furfural. The denitrified coker oil passes from extraction unit 24 via line 26 for further processing.

The coker feedstock may be any type of hydrogenated liquid hydrocarbon feed such as shale oils, coal-derived oils, or petroleum oils which contain a high level of nitrogen contaminants. Coal-derived oils, which have been previously hydrogenated, are particularly preferred. The latter oils typically contain nitrogenous contaminants in excess of 600 parts per million, which were sufficiently stable to survive the initial coal liquefaction process and thus present particularly difficult problems of removal. Furthermore, the whole synthetic crude or coal-derived oil may be charged to the coker or only a specified cut thereof, such as a 500° F.+ portion. The coking step has been discovered to significantly reduce the nitrogen content in the overhead $C_5$+ coker oil by as much as 60%.

The term "liquid-liquid extracting conditions" as used herein means ordinary and well-known extraction process conditions, including the use of (1) at least sufficient amount of extracting liquid to provide separate extract and raffinate phases and (2) a combination of temperatures and pressures sufficient to maintain said liquid phases.

Any suitable form of apparatus may be used. In general, the various means customarily employed in extraction processes to increase the degree of contact between the oil charged and the solvent may be employed. Thus, the apparatus used in the present process can comprise a single extraction zone or multiple extraction zones equipped with devices to facilitate contacting, such as mixers, stirrers, and/or slats. The operation may also be conducted either as a batch or continuous process, with the continuous mode of operation being preferred. Known techniques for decreasing the solvent selectivity of the extracting solvent for hydrocarbons can also be employed within the spirit and scope of this invention. Examples of these are: the use of small amounts of anti-solvents, e.g., water, during extraction of the oil with the organic solvent; operating at fairly low temperatures sufficient to effect the desired extraction objective; and using low solvent-to-oil ratios.

Conventional extraction fluids have been found to be unsatisfactory for removing residual nitrogenous contaminants from a hydrogenated oil. For example, furfural is found to be ineffective in extracting a hydrogenated creosote oil containing about 70 ppmw of residual nitrogen compounds. Thus, after three extractions using furfural solvent in a 1:1 solvent-to-oil volumetric ratio, only about 56% of the nitrogenous components were removed. However, when the extraction was carried out under the same conditions except that the furfural contained approximately 5% ferric chloride by weight, at least 99% of the residual nitrogenous components of the oil were removed. This is a surprising and useful result, especially in view of the fact that no precipitate was formed and little, if any, polymerization of the furfural solvent occurred.

Preferably at least a major portion of the extracting solvent should be furfural. If the above-described extraction is performed under the same conditions except that 50 volume percent of the furfural is replaced with methanol, only 93% of the nitrogenous components are removed.

It is particularly preferred that undiluted furfural be used as the extraction medium; however, satisfactory results have been attained with approximately 80 volume percent furfural. Where a diluted solvent is used, the diluent is preferably a lower alkanol, for example methanol, ethanol, and/or equivalent relatively polar organic compounds.

The furfural solvent used in the process may be recovered by any suitable known method, for example by distillation. The concentration of ferric chloride in the extracting solution should be in the range from about 0.001 to 10 weight percent and preferably 0.1 to 1 weight percent. Preferably the temperature of the extraction step should be maintained below about 50° C. and the solvent-to-oil ratio is preferred to be below 5, although higher temperatures and solvent-to-oil ratios may be used and yet obtain a beneficial extraction. As the temperature is increased, the solubility of oil in the furfural solution and the solubility of furfural in the oil phase increases. As a result, the efficiency of the process decreases with increasing temperature. A solvent-to-oil ratio in the range of from about 5 to 0.1 has been discovered to be satisfactory. Preferably the operating conditions herein include an extracting temperature in the range of 10° C. to 30° C. and a volumetric solvent-to-oil ratio of about 0.5 to 1.5. In a particularly preferred aspect of the invention, the phase separation is effected at a temperature which is in the range of about 5° to 25° C. lower than the extracting temperature used.

EXAMPLE

A 300°–1200° F.-boiling-range hydrogenated coal oil having a specific gravity of 0.994 and a nitrogen contaminant content of approximately 900 parts per million by weight was coked at a temperature of 1000° F. and a pressure of 1 atmosphere. The coking step produced 5% coke and 92.9% $C_5+$ liquids by weight. The nitrogen content in the $C_5+$ liquid was measured and found to be reduced to approximately 300 ppm. The coker-oil nitrogen compounds were then extracted with a solution of 5% $FeCl_3 \cdot 6H_2O$ in furfural solvent at a solvent-to-oil volumetric ratio of 1.0, using a 4-stage pseudo-countercurrent extraction procedure. The nitrogen contaminant of the raffinate was thereupon reduced to 2.5 ppm.

What is claimed is:

1. A process for upgrading a hydrogenated oil containing nitrogenous components above 300 parts per million, measured as nitrogen, comprising: (1) coking said hydrogenated oil to produce coke and a coker oil, said coker oil having a lower weight proportion of nitrogenous components contained therein than said coke; (2) extracting a major portion of said nitrogenous components from said coker oil with a solution of ferric chloride, said extracting being conducted under conditions including (a) a temperature in the range from about 0° to 50° C., and (b) a solution-to-oil volume ratio in the range from about 0.1 to 5, said solution comprising at least a major portion of furfural as a solvent thereof and containing said ferric chloride therein in the range from about 0.001 to 10 weight percent, thereby forming a raffinate oil phase containing a minor portion of said coker oil nitrogenous components and an extract phase containing a major portion of said coker oil nitrogenous components; and (3) separation said raffinate oil phase from said extract phase.

2. A process as recited in claim 1 wherein said coking step is accomplished by a delayed coking process.

3. A process as recited in claim 1 wherein said extracting and separating steps are accomplished by continuous countercurrent contacting of the solution and oil.

4. A process as recited in claim 1 wherein said separating step is conducted at a temperature lower than said extracting step.

5. A process as recited in claim 1 wherein said solvent consists essentially of furfural.

6. A process as recited in claim 1 wherein said solution-to-oil volume ratio is in the range of 0.5 to 1.5 and said ferric chloride is present in the solution in the range of about 0.1 to 1 weight percent.

7. A process as recited in claim 1 wherein said temperature is in the range of 10° C. to 30° C.

* * * * *